US010442672B2

(12) United States Patent
Xing

(10) Patent No.: US 10,442,672 B2
(45) Date of Patent: Oct. 15, 2019

(54) WATER TAKING DEVICE FOR BARRELED WATER BUCKET

(71) Applicant: Haoyu Xing, Shenzhen (CN)

(72) Inventor: Haoyu Xing, Shenzhen (CN)

( * ) Notice: Subject to any disclaimer, the term of this patent is extended or adjusted under 35 U.S.C. 154(b) by 0 days.

(21) Appl. No.: 15/779,549

(22) PCT Filed: Nov. 30, 2015

(86) PCT No.: PCT/CN2015/095958
§ 371 (c)(1),
(2) Date: May 29, 2018

(87) PCT Pub. No.: WO2017/091937
PCT Pub. Date: Jun. 8, 2017

(65) Prior Publication Data

US 2018/0346310 A1 Dec. 6, 2018

(51) Int. Cl.
*B67D 1/08* (2006.01)
*B67D 1/00* (2006.01)

(52) U.S. Cl.
CPC ..... *B67D 1/08* (2013.01); *B67D 1/00* (2013.01)

(58) Field of Classification Search
CPC ..... B67D 1/08; B67D 1/00; B65D 2251/08; B65D 41/04; B65D 53/00; B65D 45/16
USPC ..... 222/385; 220/287, 304
See application file for complete search history.

(56) References Cited

U.S. PATENT DOCUMENTS 2,547,109 A * 4/1951 Flavius ..... B05B 11/3001 222/321.9
2,861,839 A * 11/1958 Mellon ..... B05B 11/0013 222/321.9
2,951,620 A * 9/1960 Sego ..... B05B 11/3015 222/385
4,444,358 A * 4/1984 Spohn ..... B60S 1/50 215/309
4,750,636 A * 6/1988 Wortham ..... B01L 99/00 220/229

(Continued)

FOREIGN PATENT DOCUMENTS

CN 201686126 U 12/2010
CN 202765485 U 3/2013

(Continued)

OTHER PUBLICATIONS

Wenjing Wang, the International Searching Authority written comments, dated Sep. 2016, CN.

*Primary Examiner* — Benjamin R Shaw

(57) ABSTRACT

The present disclosure provides a water taking device for a barreled water bucket. The water taking device includes a fixing apparatus. One end of the fixing apparatus is fixedly connected with a bucket opening of the barreled water bucket. The aperture size of the fixing apparatus is adjustable to adapt to bucket openings of barreled water buckets having different apertures. As the fixing apparatus and the bucket opening of the barreled water bucket are fixedly connected, and the aperture of the fixing apparatus is adjustable to adapt to the bucket openings of the barreled water buckets having different apertures, the present disclosure may ensure that the water taking device may take water from the barreled water bucket successfully under a stably connected environment to facilitate use by a user.

10 Claims, 5 Drawing Sheets

(56) References Cited

U.S. PATENT DOCUMENTS

| | | | | |
|---|---|---|---|---|
| 2004/0124170 | A1* | 7/2004 | Sherrod | A47G 19/2272 215/319 |
| 2010/0018972 | A1* | 1/2010 | Kao | B65D 51/1633 220/212 |
| 2011/0052768 | A1* | 3/2011 | Py | B65D 51/002 426/234 |
| 2011/0290678 | A1* | 12/2011 | Simonian | B65D 47/243 206/219 |
| 2012/0145728 | A1* | 6/2012 | Pounder | B65D 43/0212 220/720 |
| 2012/0193358 | A1* | 8/2012 | Billado, Jr. | B65D 43/02 220/212 |

FOREIGN PATENT DOCUMENTS

| | | | |
|---|---|---|---|
| CN | 204024946 | U | 12/2014 |
| CN | 204126829 | U | 1/2015 |
| FR | 2537092 | A1 | 6/1984 |

* cited by examiner

WATER TAKING DEVICE FOR BARRELED WATER BUCKET

TECHNICAL FIELD

The present disclosure relates to the technical field of living goods, and more particularly to a water taking device for a barreled water bucket.

BACKGROUND

Because of the scientific and technological progress and the increase of the living standard, water taking devices for facilitating the use of water dispensers emerge continuously. To solve the problem on directly vertical extraction of barreled water for drinking and avoid secondary pollution caused by the use of the water dispensers, an disclosure patent No. CN202873028 disclosed on Jan. 28, 2015 relates to a hand pump used for barreled water. The hand pump includes a base, a water pumping pipe mounted below the base, and a water discharging pipe located on the side of the base, and is characterized in that an upper end of the base is connected with a pump shell. An air drum is disposed in the pump shell. An air drum seat is disposed at the lower end of the air drum. An air feeding seal and an air discharging seal are disposed in the air drum seat. A gland is disposed at the upper end of the air drum. The hand pump occupies a small space, is convenient to carry and mount, and is convenient for water pumping. The gland is operated vertically, and spring return handfeel is strong. By full use of an air bag of the air drum, a force applied to the air drum is relatively low, so that the hand pump is suitable for people of all ages. When the hand pump is not used, water is in no contact with a pump body, so that no secondary pollution is caused to the barreled water. A fixed seat at the lower end of the base is connected and matched with a barreled water bucket opening. However, not all barreled water bucket openings are in same size. If the size of the bucket opening is smaller than a size of the fixed seat, the sealing reliability would be reduced. If the size of the bucket opening is larger than the size of the fixed seat, requirements for stable connection and successful water taking may not be met.

SUMMARY

The present disclosure provides a simple-structure and use-convenience water taking device for a barreled water bucket to solve the technical problems.

The purpose of the present disclosure is achieved by the following technical solution: a water taking device for a barreled water bucket includes a fixing apparatus. One end of the fixing apparatus is fixedly connected with a bucket opening of the barreled water bucket. The aperture size of the fixing apparatus is adjustable to adapt to bucket openings of barreled water buckets having different apertures.

Preferably, the fixing apparatus is disposed at the bucket opening of the barreled water bucket in a sleeving manner. A use position of the fixing apparatus is specified, and the sleeving arrangement mode is convenient for installation.

Preferably, the fixing apparatus is provided with a water taking seal and an adjustment portion. The water taking seal is fixedly connected with the adjustment portion. The water taking seal is made of an elastic material. The water taking seal is hermitically connected with the bucket opening of the barreled water bucket. The aperture size of the adjustment portion is adjustable to adapt to the bucket openings of the barreled water buckets having different apertures. Specific settings of the fixing apparatus are specified. The water taking seal made of the elastic material is hermitically connected with the bucket opening of the barreled water bucket, so as to guarantee the sealing property of a water taking environment. The adjustment portion adjusts own aperture to adapt to the bucket openings of the barreled water buckets having different apertures. The adjustment portion is matched with the water taking seal to ensure that the water taking device may take water from the barreled water bucket under a stably connected and well sealed environment in case of the bucket openings of the barreled water buckets having different sizes.

Preferably, the adjustment portion includes a fixing member and an adjustment member. The fixing member is fixedly connected with the water taking seal. The adjustment member is disposed on the fixing member in a sleeving manner. Setting members of the adjustment portion and various connection relations of the adjustment portion are specified.

Preferably, the fixing member is provided with a connection end connected with the water taking seal and an adjustment thread. The fixing member is conical. Adjustment gaps are perpendicular to the adjustment thread. The way of forming the adjustment gaps in the adjustment thread is favorable for realizing adjustment of tightness, and a size change of the adjustment thread may lower the gravity center to facilitate stabilization during use and placement.

Preferably, at least two adjustment gaps are set. The adjustment gaps are formed in the adjustment thread in an equal-angle spacing manner. Stress is uniform, so that the frequency of replacing the fixing member may be reduced, and the service life is prolonged.

Preferably, the fixing member is provided with the adjustment thread. The adjustment member is of an annular structure. The inner side of the adjustment member is provided with a thread structure corresponding to the adjustment thread. The adjustment member moves up and down to adjust the tightness of the connection between the water taking seal and the barreled water bucket opening. The structure is simple, and the use is convenient.

Preferably, the outer side of the adjustment member is provided with non-slip wrenches, so that a user can use the device more conveniently with less effort during force application.

Preferably, the elastic material is rubber. The rubber is high in sealing property, easy to obtain and low in price.

Preferably, the water taking seal is provided with a first clamping groove, and the adjustment portion is correspondingly provided with a first clamping position, so that the water taking seal and the adjustment portion are fixedly connected through the first clamping groove and the first clamping position. The water taking seal is provided with the first clamping position, and the adjustment portion is correspondingly provided with the first clamping groove, so that the water taking seal and the adjustment portion are fixedly connected through the first clamping position and the first clamping groove.

As the fixing apparatus and the bucket opening of the barreled water bucket are fixedly connected, and the aperture of the fixing apparatus is adjustable to adapt to the bucket openings of the barreled water buckets having different apertures, the present disclosure may ensure that the water taking device may take water from the barreled water bucket successfully under the stably connected environment to facilitate use by the user.

In the figures: 1 fixing apparatus; 2 water taking seal; 21 clamping groove; 3 adjustment portion; 4 fixing member; 41 adjustment gap; 42 first clamping position; 5 adjustment member; 51 non-slip wrench; 6 base; and 61 locating structure.

DETAILED DESCRIPTION

The present disclosure will be further described below in combination with the drawings and preferred embodiments.

Figure 1:
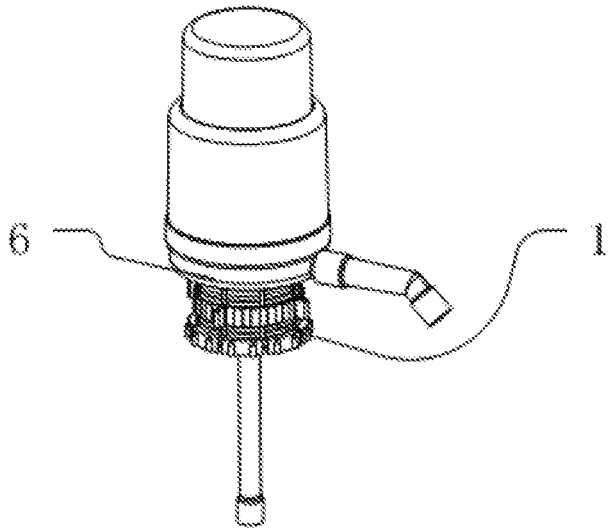
FIG. 1 is a structural schematic diagram of a water taking device according to an embodiment of the present disclosure.
Figure 2:
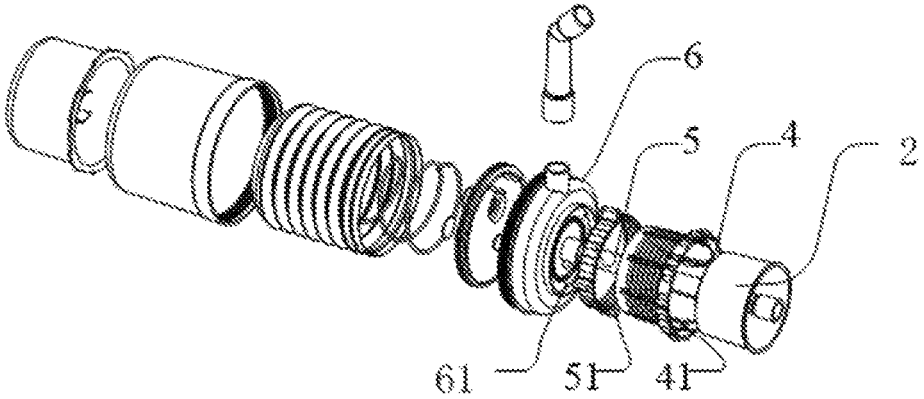
FIG. 2 is an exploded diagram of a water taking device according to an embodiment of the present disclosure.
Figure 3:
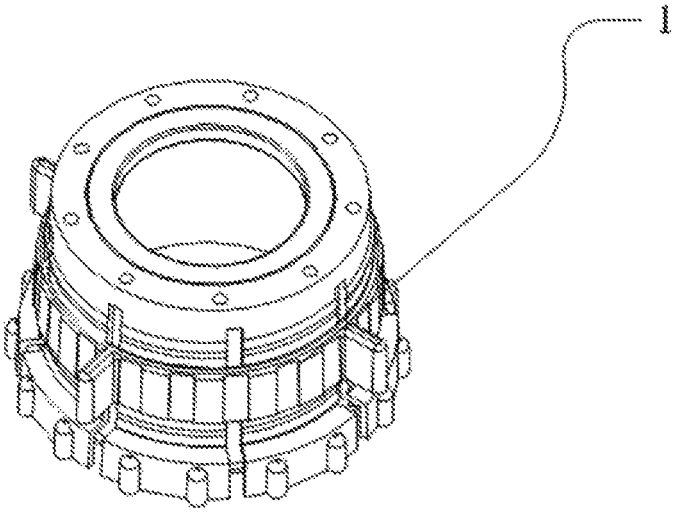
FIG. 3 is a structural schematic diagram of a fixing apparatus according to an embodiment of the present disclosure.

As shown in FIGS. 1 to 3, a water taking device for a barreled water bucket is provided. The water taking device includes a fixing apparatus 1. One end of the fixing apparatus 1 is fixedly connected with a bucket opening of the barreled water bucket. The aperture size of the fixing apparatus 1 is adjustable to adapt to bucket openings of barreled water buckets having different apertures. The fixing apparatus 1 may be disposed at the bucket opening of the barreled water bucket in a sleeving manner. The sleeving arrangement mode of the fixing apparatus 1 is convenient for installation. The fixing apparatus 1 is provided with a water taking seal 2 and an adjustment portion 3. The water taking seal 2 is fixedly connected with the adjustment portion 3. The water taking seal 2 is made of an elastic material. The water taking seal 2 is hermitically connected with the bucket opening of the barreled water bucket. The aperture size of the adjustment portion 3 is adjustable to adapt to the bucket openings of the barreled water buckets having different apertures. Specific settings of the fixing apparatus are specified. The water taking seal 2 made of the elastic material is hermitically connected with the bucket opening of the barreled water bucket, so as to guarantee the sealing property of a water taking environment. The adjustment portion 3 adjusts own aperture to adapt to the bucket openings of the barreled water buckets having different apertures. The adjustment portion 3 is matched with the water taking seal 2 to ensure that the water taking device may take water from the barreled water bucket under a stably connected and well sealed environment in case of the bucket openings of the barreled water buckets of different sizes. The fixing apparatus 1 also may be a structure disposed in the bucket opening of the barreled water bucket. In case of the bucket openings of the barreled water buckets of different sizes, the structure is outwards expanded to adapt to a relatively large size, and is inwards shrunk to adapt to a relatively small size.

The present embodiment is applied to the water taking device for the barreled water bucket. The water taking device also may include the adjustment portion 3. The adjustment portion 3 is fixedly connected with the bucket opening of the barreled water bucket. The aperture size of the adjustment portion 3 is adjustable to adapt to the bucket openings of the barreled water buckets having different apertures. The adjustment portion 3 includes a fixing member 4 and an adjustment member 5. The fixing member 4 is connected with the bucket opening of the barreled water bucket. The adjustment member 5 is disposed on the fixing member 4 in a sleeving manner. The fixing member 4 is conical. A size change of the fixing member 4 may lower the gravity center to facilitate stabilization during use and placement. The adjustment portion 3 also may be a structure disposed in the bucket opening of the barreled water bucket. In case of the bucket openings of the barreled water buckets of different sizes, the structure is outwards expanded to adapt to a relatively large size, and is inwards shrunk to adapt to a relatively small size.

The present embodiment is applied to the water taking device of the barreled water bucket. The water taking device also may include the water taking seal 2. The water taking seal 2 is conical, made of an elastic material and disposed at the bucket opening of the barreled water bucket in a sleeving manner. The water taking seal 2 is adjusted to adapt to the bucket openings of the barreled water buckets having different apertures. The water taking seal 2 is simple in structure. By lowering the conical gravity center, the water taking seal 2 is stably placed. Through the adoption of the elastic material, the water taking seal 2 deforms easily, and is in close contact with the bucket openings of the barreled water buckets having different aperture sizes during use. The water taking seal 2 is only required to be disposed at the bucket opening of the barreled water bucket in the sleeving manner, so that it is convenient to use, and is applicable to the barreled water buckets in the field of daily life.

Figure 4:
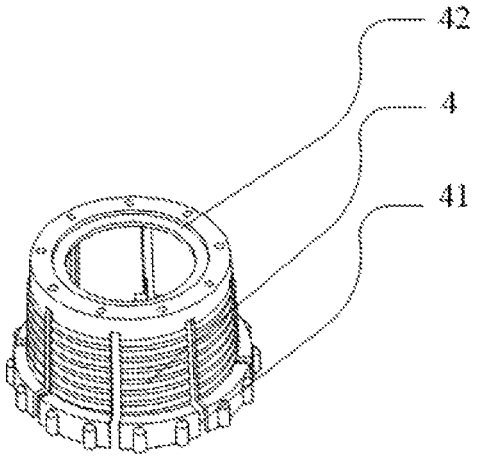
FIG. 4 is a structural schematic diagram of a fixing member according to an embodiment of the present disclosure.
Figure 5:
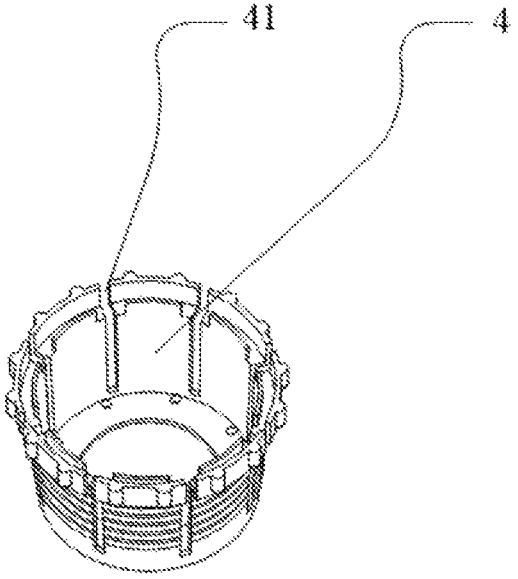
FIG. 5 is also a structural schematic diagram of a fixing member according to an embodiment of the present disclosure.
Figure 6:
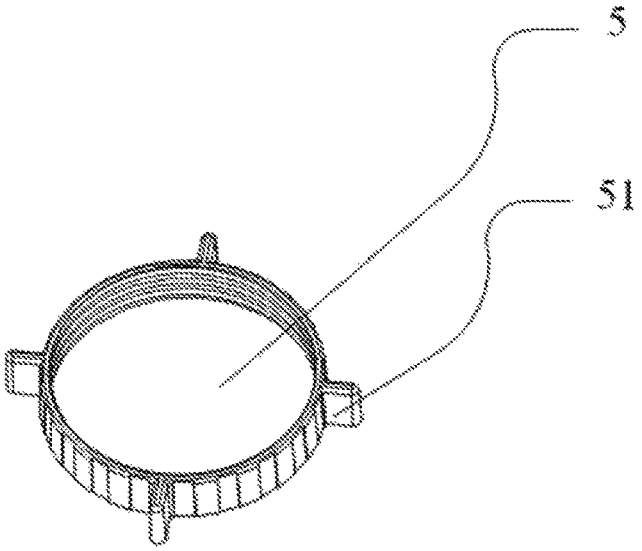
FIG. 6 is a structural schematic diagram of an adjustment member according to an embodiment of the present disclosure.

As shown in FIGS. 4 to 6, this embodiment is applied to the adjustment portion 3 of the water taking device of the barreled water bucket. The adjustment portion 3 includes the fixing member 4 and the adjustment member 5. The fixing member 4 is connected with the bucket opening of the barreled water bucket. The adjustment member 5 is disposed on the fixing member 4 in the sleeving manner. The fixing member 4 is conical. A size change of the fixing member 4 may lower the gravity center to facilitate stabilization during use and placement. The fixing member 4 is provided with an adjustment thread. Adjustment gaps 41 are formed in the adjustment thread. The adjustment gaps 41 are perpendicular to the adjustment thread. The way of forming the adjustment gaps 41 in the adjustment thread is favorable for realizing adjustment of tightness. At least two adjustment gaps 41 are set. The adjustment gaps 41 are formed in the adjustment thread in an equal-angle spacing manner. Stress is uniform, so that the frequency of replacing the fixing member may be reduced, and the service life is prolonged. Eight adjustment gaps may be set. The fixing member 4 is provided with the adjustment thread. The adjustment thread may be an external thread. The adjustment member 5 is of an annular structure. The inner side of the adjustment member 5 is provided with a thread structure corresponding to the adjustment thread. The adjustment member 5 moves up and down to adjust the tightness of the connection between the water taking seal and the barreled water bucket opening, so that the structure is simple, and the use is convenient. The adjustment member 5 may also adjust the fixing member 4 and the aperture in a radial moving manner similar to the moving manner of a waistband. The outer side of the adjustment member 5 is provided with non-slip wrenches 51, so that a user can use the device more conveniently with less effort during force application. Four non-slip wrenches 51 may be provided in an equal-angle spacing manner.

In the embodiment of the water taking device for the barreled water bucket, which includes the water taking seal 2 and the adjustment portion 3, the fixing member 4 is provided with a connection end connected with the water taking seal 2.

Figure 7:
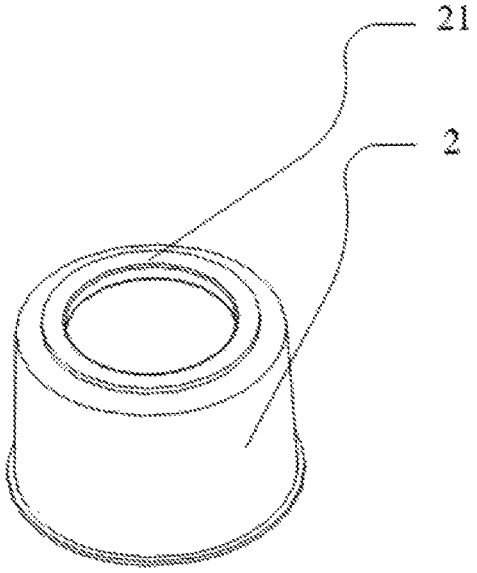
FIG. 7 is a structural schematic diagram of a water taking seal according to an embodiment of the present disclosure.
Figure 8:
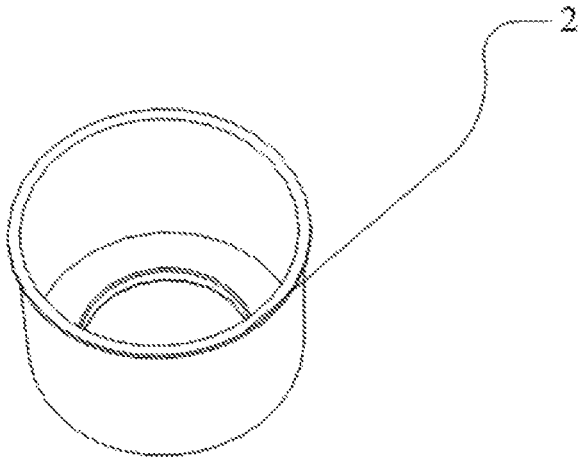
FIG. 8 is also a structural schematic diagram of a water taking seal according to an embodiment of the present disclosure.

As shown in FIGS. 7 and 8, the present embodiment is applied to the water taking seal 2 of the water taking device for the barreled water bucket. The water taking seal is made of the elastic material. The elastic material may be rubber. The rubber is high in sealing property, easy to obtain and low in price.

In the embodiment of the water taking device for the barreled water bucket, which includes the water taking seal 2 and the adjustment portion 3, the water taking seal 2 is provided with a first clamping groove, and the adjustment portion 3 is correspondingly provided with a first clamping position 42, so that the water taking seal 2 and the adjustment portion 3 are fixedly connected through the first clamping groove and the first clamping position. Or, the water taking seal 2 is provided with the first clamping position, and the adjustment portion 3 is correspondingly provided with the first clamping groove, so that the water taking seal 2 and the adjustment portion 3 are fixedly connected through the first clamping position and the first clamping groove.

Figure 9:
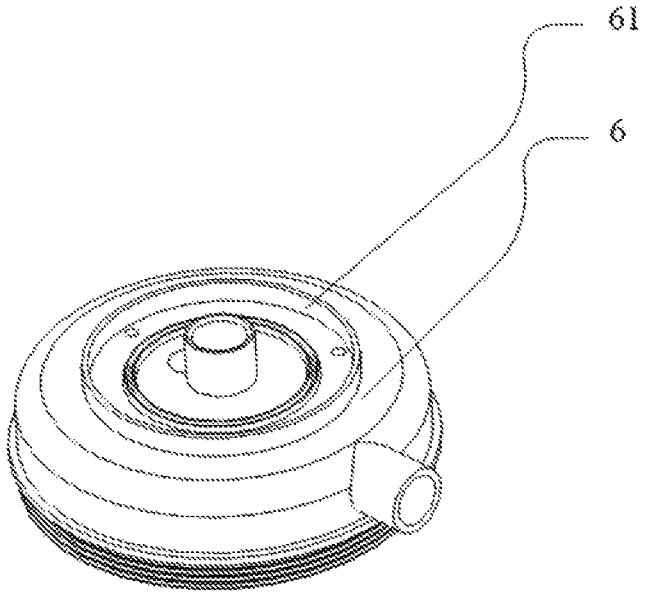
FIG. 9 is a structural schematic diagram of a base according to an embodiment of the present disclosure.

As shown in FIG. 9, the base 6 is provided with a locating structure 61 for the fixing apparatus 1. The locating structure includes a locating ring and a screw hole. The base 6 is connected with the fixing apparatus 1 through a screw.

The locating structure 61 also may be applicable to an embodiment of the water taking device for the barreled water bucket, which only includes the water taking seal 2 or the adjustment portion 3.

The above contents are further detailed descriptions of the present disclosure in combination with specific preferred embodiments. However, the specific implementation of the present disclosure shall not be considered to be only limited to these descriptions. For those ordinary skilled in the art to which the present disclosure belongs, several simple deductions or replacements may be made without departing from the conception of the present disclosure, all of which shall be considered to belong to the protection scope of the present disclosure.

The invention claimed is:

1. A water taking device for a barreled water bucket, comprising a fixing apparatus, wherein one end of the fixing apparatus is fixedly connected with a bucket opening of the barreled water bucket; and the aperture size of the fixing apparatus is adjustable to adapt to bucket openings of barreled water buckets having different apertures; and the fixing apparatus comprises a water taking seal and an adjustment portion having a fixing member and an adjustment member; the fixing member is fixedly connected with the water taking seal; and the adjustment member is disposed on the fixing member in a sleeving manner.

2. The water taking device according to claim 1, wherein the fixing apparatus is disposed at the bucket opening of the barreled water bucket in a sleeving manner.

3. The water taking device according to claim 1, wherein the water taking seal is fixedly connected with the adjustment portion; the water taking seal is made of an elastic material; the water taking seal is hermitically connected with the bucket opening of the barreled water bucket; and the aperture size of the adjustment portion is adjustable to adapt to the bucket openings of the barreled water buckets having different apertures.

4. The water taking device according to claim 1, wherein the fixing member is provided with a connection end connected with the water taking seal and an adjustment thread; the fixing member is conical; and adjustment gaps are formed in the adjustment thread, and are perpendicular to the adjustment thread.

5. The water taking device according to claim 4, wherein at least two adjustment gaps are set, and are formed in the adjustment thread in an equal-angle spacing manner.

6. The water taking device according to claim 4, wherein the fixing member is provided with the adjustment thread; the adjustment member is of an annular structure; and the inner side of the adjustment member is provided with a thread structure corresponding to the adjustment thread.

7. The water taking device according to claim 6, wherein the outer side of the adjustment member is provided with non-slip wrenches.

8. The water taking device according to claim 3, wherein the elastic material is rubber.

9. The water taking device according to claim 3, wherein the water taking seal is provided with a first clamping groove, and the adjustment portion is correspondingly provided with a first clamping position, so that the water taking seal and the adjustment portion are fixedly connected through the first clamping groove and the first clamping position; and the water taking seal is provided with the first clamping position, and the adjustment portion is correspondingly provided with the first clamping groove, so that the water taking seal and the adjustment portion are fixedly connected through the first clamping position and the first clamping groove.

10. The water taking device according to claim 2, wherein the water taking seal is fixedly connected with the adjustment portion; the water taking seal is made of an elastic material; the water taking seal is hermitically connected with the bucket opening of the barreled water bucket; and the aperture size of the adjustment portion is adjustable to adapt to the bucket openings of the barreled water buckets having different apertures.

* * * * *